US005562163A

United States Patent [19]

Sartain et al.

[11] Patent Number: 5,562,163

[45] Date of Patent: Oct. 8, 1996

[54] HOME FIRE-FIGHTING APPARATUS

[76] Inventors: Samuel D. Sartain, P.O. Box 90, Hull, Ga. 30646; C. Randolph Bergmann, 6329 Woodlake Dr., Buford, Ga. 30518

[21] Appl. No.: 297,164

[22] Filed: Aug. 29, 1994

[51] Int. Cl.[6] ..... A62C 35/20

[52] U.S. Cl. ..... 169/51; 312/242

[58] Field of Search ..... 169/51; 137/355.28; 312/242, 248, 329, 265.6, 293.3, 293.2, 326

[56] References Cited

U.S. PATENT DOCUMENTS

| | | | |
|---|---|---|---|
| 2,686,644 | 8/1954 | Pratt | 312/242 |
| 2,871,083 | 1/1959 | Pokryfke | 312/242 |
| 2,878,955 | 3/1959 | Hagan | 312/242 |
| 3,091,251 | 5/1963 | Hughey | 137/355.28 |
| 3,918,782 | 11/1975 | Allmand | 312/242 |
| 4,006,948 | 2/1977 | Kessinger | 312/242 |
| 4,018,242 | 4/1977 | Schlegel | 169/51 |
| 4,062,493 | 12/1977 | Suggs | 169/51 |
| 4,076,350 | 2/1978 | Crist | 312/242 |
| 4,158,471 | 6/1979 | Logsdon | 312/242 |
| 4,244,426 | 1/1981 | Kerr | 169/51 |
| 4,380,269 | 4/1983 | Petaway et al. | 169/51 |
| 4,941,716 | 7/1990 | Rome et al. | 312/242 |

*Primary Examiner*—Gary C. Hoge
*Attorney, Agent, or Firm*—Earl D. Harris

[57] ABSTRACT

A fire-fighting apparatus for use in the home or a small office employing an enclosure or cabinet designed to fit in a wall and between the studs thereof, into which a water supply line is attached to a control valve, attached in turn to a coiled lay-flat garden-type hose. The coil of hose is held to the rear of the cabinet by compression against the interior walls of the cabinet and has an adjustable spray nozzle attached to the free end thereof. One or more chemical fire extinguishers may also be housed in the cabinet.

4 Claims, 2 Drawing Sheets

HOME FIRE-FIGHTING APPARATUS

BACKGROUND OF THE INVENTION

The present invention relates generally to a home or small office fire-fighting apparatus, more particularly a water hose and other apparatus for fighting a small fire, and the enclosure or cabinet to house such apparatus that will fit between and attach to the studs of a wall, allowing the face or door thereof to be more flush with the wall itself.

Previous to the present invention home fire-fighting apparatus, and enclosures for the same, have been known in the state of the art. U.S. Pat. Nos. 3,918,782; 4,018,242; 4,244,426; 4,380,269; and 4,998,587 are typical examples of the prior art. Generally, the prior art apparatus included some or all of the following: water supply, hose, method of storing the hose, extinguishers and a cabinet or enclosure to house the other apparatus, said cabinet primarily being mounted onto a wall. The mounting of the cabinet onto the surface of a wall is both a distraction aesthetically and a hazard by protruding into the room.

An exception is U.S. Pat. No. 4,244,426 which is designed to mount within the wall and flush to the exterior surface; however, the hose used in this example of prior art is a flay-lying and folded fire hose, which is both difficult to refold and insert back into the cabinet once used, and if unused for an extended period of time may become brittle and the folds and tend to leak. Replacement of this type of hose is difficult. Further the cabinet opens downward, making accessibility difficult.

SUMMARY OF THE INVENTION

The present invention overcomes the problems associated with the inadequacies of such prior home fire-fighting apparatus by providing a cabinet that fits between the standard studs of a wall and flush to the exterior of the wall itself, provides a more accessible opening, and a type and arrangement of hose that is easily used and restored. It includes a storage enclosure or cabinet that fits into the wall between the studs so that the sideward swinging door or face is substantially flush with the surface of the wall, with a door and framing thereof that can be painted or stained to match the interior decor of the room and is easily removable and interchangeable for changes in that decor. The interior of the enclosure is equipped with a water supply line from the normal household water supply system, a hand operated valve and a unique lay-flat garden-type water hose equipped with an adjustable spray nozzle. The coiled hose, in its static condition, naturally expands to apply light but a holding, pressure against the interior walls of the cabinet, holding the hose in the cabinet itself by friction. The hose is coiled from the outside inward, with the nozzle in the center. This holding pressure or friction of the hose against the interior walls allows the hose to be dispensed from the inside outwardly without the entire coil falling out of the cabinet and becoming entangled. A chemical and/or inert gas fire extinguisher is also included for special fires (electrical, gas, grease, etc.).

A primary object of the present invention is to provide a simple and dependable apparatus that is economical in construction and easily used by a lay person to fight small fires in a home or small office.

A further object of the invention is to provide a home fire fighting apparatus that is easily mounted by a lay person in the wall of a framed structure between the wall studs of the same, in that the invention (apparatus) comes complete with all necessary pipe, compression tees, ball valves, instructions, and other things (except tools) to make it easy for a lay person to install.

A further object of the present invention is to provide a fire-fighting apparatus enclosure that mounts directly into a wall in the recess between the studs thereof to provide a door or front that is relatively flush to the surface of the wall, allowing the use of interchangeable framing around the opening that can match the decor of the room in which it is used, giving a more pleasing aesthetic appearance and lowering the hazard of an enclosure protruding into the interior of a room.

A further object of the invention is to provide a home fire fighting apparatus that utilizes component parts available for replacement on the open market.

DETAILED DESCRIPTION OF THE PREFERRED EMBODIMENT

Figure 2:
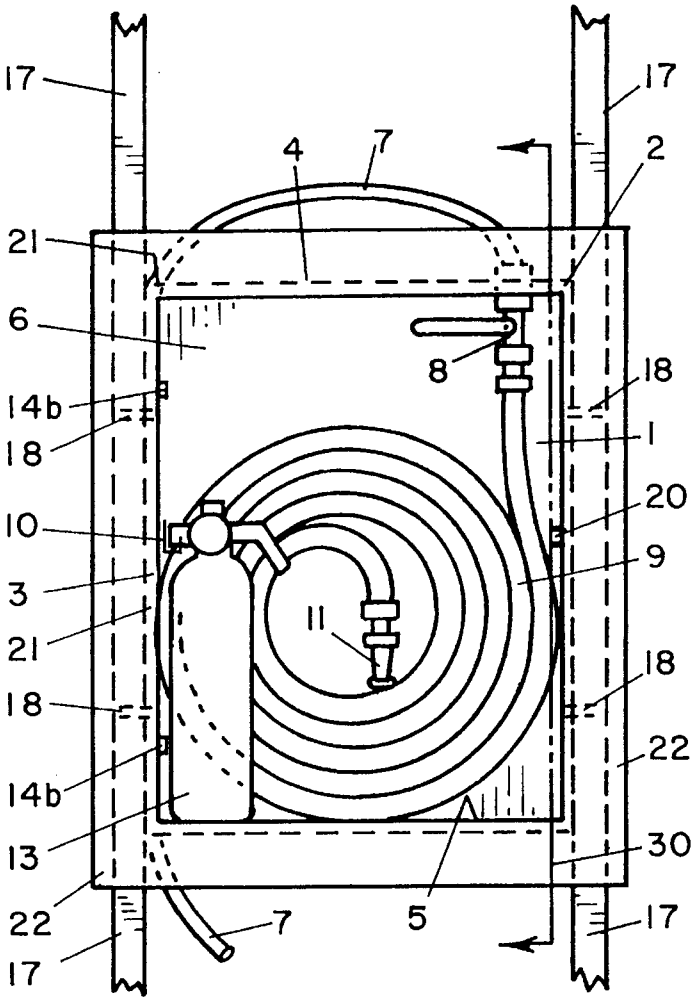
FIG. 2 is a frontal elevation view of the apparatus with the door removed.
Figure 1:
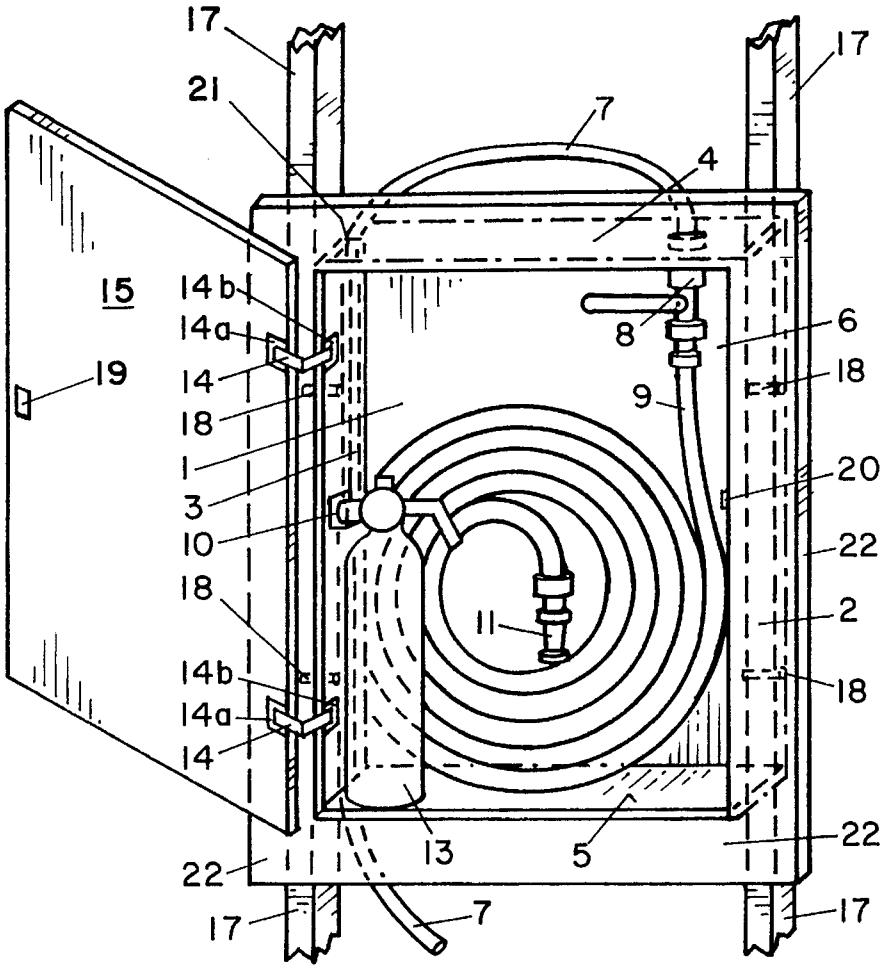
FIG. 1 is a perspective view of the home fire-fighting apparatus showing the cabinet with the door open and the component parts exposed for view.
Figure 5:
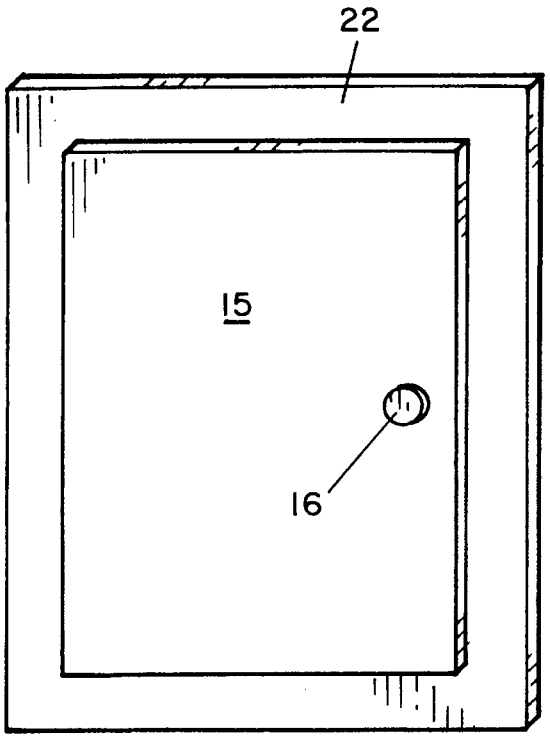
FIG. 5 is a perspective view of the home fire-fighting apparatus as mounted in a wall with the door closed.
Figure 4:
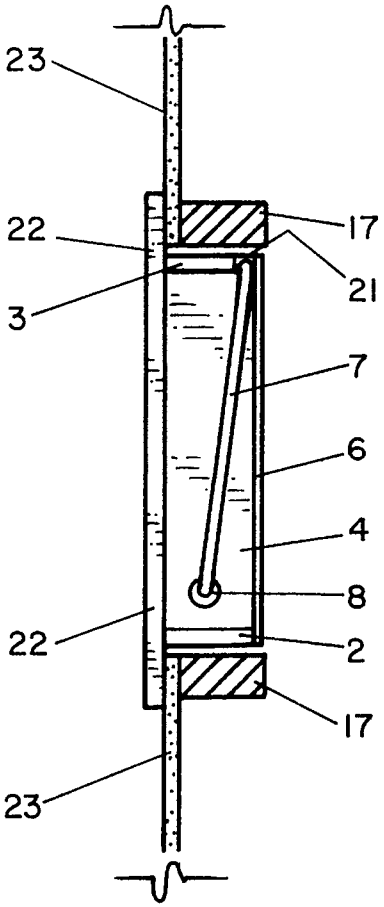
FIG. 4 is a top elevation view of the apparatus with the door removed.
Figure 3:
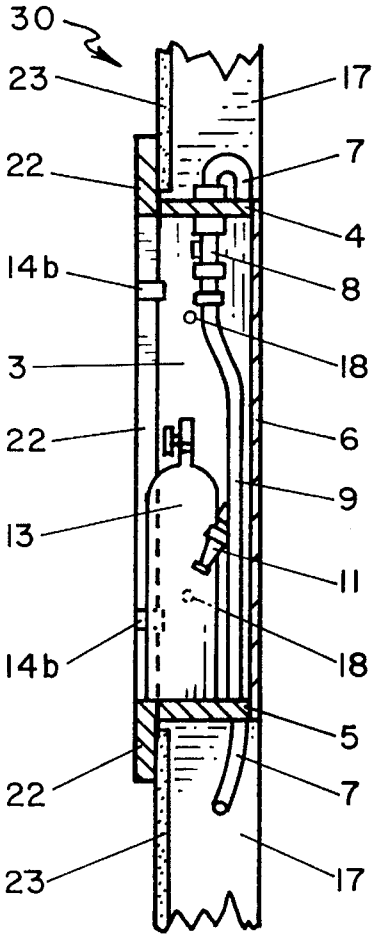
FIG. 3 is a side cross-sectional view of the apparatus taken substantially along the line A—A in FIG. 2.

Although as can be seen in the drawings and in this description numerous embodiments of the present invention are possible, the preferred embodiment, as shown in FIGS. 1–5, is an enclosure of cabinet 1 constructed of sheet metal, plastic, wood or other suitable like material. Said cabinet 1 has a top 4, a bottom 5, a back 6, and both a first side 2 and a second side 3. In addition the cabinet 1 is equipped with a door 15 hingably attached to the second side 3 by hinges 14. The hinges 14 are of a commercially available spring-activated type that will remain in an open position when fully opened but will force the door closed in any position less than fully open. Further, the hinges 14 are separable, so that the door mounting portion **14*a* easily detaches from the cabinet mounting portion 14*b*, allowing the door 15 to be easily removed or replaced with another interchangeable door 15. The door 15 itself may also be equipped with a pull-type handle 16 and a friction or magnetic latch 19. The corresponding or second latch portion 20 is mounted in a corresponding position on the inside of the first side 2 of the cabinet 1 so that the latch 19 and the seconding latch portion 20 engage when the door 15** is in a closed position.

The cabinet 1 is also furnished with a removable door frame 22. The frame 22 removably attaches to the cabinet 1 itself, and not to the wall surface 23 of the structure, by means of cam locks, dowel pins and screws. In addition to the aesthetic aspects of the way that it looks, the frame 22 also protects the wall surface 23 of the structure and having it attach directly to the cabinet 1, instead of the structure's wall surface 23 allows its removal without damage to the wall surface 23 itself.

The cabinet 1 itself is mounted between the studs 17 with a plurality of screws 18 or other like attaching devices, and is the same depth as the studs 17 themselves.

The preferred embodiment of the invention shows a water supply line 7, coming from the standard domestic water supply system and entering the cabinet 1 through the top 4. The water supply line 7 may be brought in from above the cabinet 1, or from below the cabinet 1 by fitting into a channel 21 that passes down the exterior of the first side 2 or second side 3 of the cabinet 1. However, it is noted that the water supply line 7 could as easily pass through the stud 17 and the second side 3 or enter the cabinet 1 through either the top 4 or bottom 5 thereof. On the interior of the cabinet 1 and attached to the terminus of the water supply line 7, a water control valve 8 is mounted to the interior of top 3 of the cabinet 1. Such water control valve 8 can be either of a typical counterclockwise opening valve or a single-lever type valve, the latter being preferred to enable a full supply of water to be furnished quickly.

Attached to the water control valve 8 is a high quality vinyl reinforced lay-flat "garden type" hose 9, The hose 9 is of heat resistant materials and is of a molded and extruded design that automatically returns to a "flat" shape when not filled with water under pressure. It is equipped with a high quality adjustable spray nozzle 11. The hose 9 is of a suitable length to reach from the cabinet 1 to the area desired to be protected that is the furthest from the cabinet 1, and may be 40 or 50 feet in length. In its natural state the hose 9 is not only "flat" in cross-sectional shape but lies straight lengthwise on a surface, and has a tendency to return to this state when external and internal pressures are not exerted on it. In the cabinet 1 the hose 9 is coiled and its natural tendency is to straighten out and uncoil. This causes the coil to expand pushing against the interior surfaces of first side 2 and the second side 3 of the cabinet 1. This tension of the coiled hose 9 against the cabinet sides 2 & 3 holds the hose 9 in the cabinet 1 without the need of additional brackets or other holding devices.

The cabinet 1 may optionally also house one or more fire extinguishers 13, of the chemical or inert gas type to assist in fighting specialized fires (gas, electrical, grease, etc.). The extinguishers 13 can simply sit on the bottom 5 panel of the cabinet 1 or may be held with a quick-release bracket 10, itself fixed to one of the interior surfaces of the cabinet 1.

In use the cabinet 1 is mounted with screws 18 or other appropriate mounting means between top studs 17 of a wall. A water supply line 7 is brought through the channel 21 and into and through the top 4 of the cabinet 1. Attached to the terminus of the water supply line 7 is the water control valve 8, itself, in turn, attached to the hose 9. Except when in use the cabinet door 15 is held closed by the spring closing hinges 14 or by the engaging of the latch 19 and the second latch part 20. At the time of need, the door 15 is opened by use of the pull handle 16, the nozzle 11 is removed from its mount (not shown in drawings), the coiled hose 9 is pulled from the cabinet 1 and begins straightening out, and the water control valve 8 is opened. Water from the water supply line 7 passes through the control valve 8 and into the hose 9, expanding and straightening the hose 9 as it passes through to the nozzle 11. The operator can then adjust the nozzle 11 to extinguish the fire.

Once the fire is extinguished and the water control valve 8 is closed, the hose 9 can be removed and drained. It (the hose 9) will automatically return to its flattened cross-sectional shape and can be recoiled, reattached to the control valve 8, and re-placed in the cabinet 1.

The fire extinguisher 13 normally does not have brackets holding it and is simply resting on the bottom 5 wall of the cabinet 1; thus it can easily and directly be removed and used as needed.

What has been disclosed is a home fire-fighting apparatus, the cabinet of which can be mounted into a wall and between the studs 17 thereof to give a flush mounting for the walls surface. Obviously, many modifications and variations of the invention are possible in light of the above teachings. It is therefore understood that the invention is not to be limited by the single embodiment shown in the drawings and described in the description, which are given by way of example and not of limitation, but only in accordance with the scope of the appended claims.

What is claimed is:

1. A fire-fighting apparatus for installation in the wall of a building with stud-structured walls and a pressurized water supply comprising:

a storage cabinet having a solid top, bottom, back and a first side panel and a second side panel forming a compartment therebetween, the front thereof being open;

a plurality of means on the sides of said cabinet for attaching said cabinet in an upright position to the studs of said stud-structured wall so that the open front forms an opening in the wall's surface;

a door frame mounted to the cabinet on the open front thereof;

a door hingably mounted on the first side panel of said cabinet to pivotally expose and close said open front, said door resting on the exterior of said door frame when closed;

a means of latching said door in a closed position to the second side panel of said cabinet;

a handle mounted on the exterior of said door to assist in the opening thereof;

a water supply line;

a water inlet and control valve mounted within said compartment for connection to said water supply, a handle for opening said valve;

a length of lay-flat plastic hose, one end of which having an adjustable water control nozzle thereon and the other end of which being attached to said water inlet and control valve, said hose being coiled and resting snugly in said compartment; and wherein the coiled plastic hose is of a flattened cross-section that inflates when carrying pressurized water inside and returns to its flattened shape when interior pressure is relieved, and is so coiled from the outside inward to cause the surface of its outermost coil to frictionally engage the interior surface of the first and second side panels of the cabinet and to rest upon the bottom and back thereof, thus allowing the hose to be dispensed from the center of the coil without falling out of the interior of the cabinet and becoming entangled.

2. A fire-fighting apparatus of claim 1 wherein a fire extinguisher is detachably mounted within said compartment with a quick-release bracket.

3. A fire-fighting apparatus of claim 2 wherein a channel is furnished in the exterior of the first or second side panel from one end thereof to the other in which the water supply line can fit.

4. A fire-fighting apparatus of claim 3 wherein the door is mounted to the cabinet by means of detachable hinges where a first portion of the hinge remains fixably attached to the door and a second portion of the hinge remains fixably attached to the first side panel of the cabinet.

* * * * *